United States Patent [19]

Naik et al.

[11] 4,137,180

[45] Jan. 30, 1979

[54] FABRIC TREATMENT MATERIALS

[75] Inventors: Appaya R. Naik, Merseyside, England; Klaus H. Todt, Hamburg, Germany; Martin A. Wells, Wirral, England

[73] Assignee: Lever Brothers Company, New York, N.Y.

[21] Appl. No.: 812,423

[22] Filed: Jul. 1, 1977

[30] Foreign Application Priority Data

Jul. 2, 1976 [GB] United Kingdom ..... 27682/76

[51] Int. Cl.[2] ..... D06M 13/46

[52] U.S. Cl. ..... 252/8.8; 8/115.6; 252/8.9; 260/404; 260/404.5 Q; 260/567.6 M

[58] Field of Search ..... 252/8.8, 8.9; 8/115.6; 260/404, 404.5 Q, 567.6 M

[56] References Cited

U.S. PATENT DOCUMENTS

| | | | |
|---|---|---|---|
| 2,897,201 | 7/1959 | Albrecht | 260/404.5 Q |
| 3,272,712 | 9/1966 | Kalopissis et al. | 260/404 |
| 3,342,840 | 9/1967 | Sobolev | 260/567.6 M |
| 3,377,382 | 4/1968 | Elanquist | 260/567.6 M |
| 3,404,183 | 10/1968 | Hughes | 260/567.6 M |
| 3,729,416 | 4/1973 | Bruning et al. | 252/8.8 |

OTHER PUBLICATIONS

Surfaces Active Agents & Detergents, vol. II, Schwartz et al., p. 265.

*Primary Examiner*—William E. Schulz
*Attorney, Agent, or Firm*—Kenneth P. Dusyn; James J. Farrell; Melvin H. Kurtz

[57] ABSTRACT

Fabric softening is provided by cationic diesters of the formula:

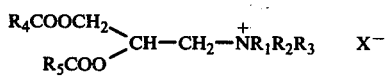

wherein $R_1$, $R_2$ and $R_3$ are each an alkyl or hydroxyalkyl group containing from 1 to 4 carbon atoms, or a benzyl group, $R_4$ and $R_5$ are each alkyl chains containing from 11 to 23 carbon atoms, and $X^-$ is a water soluble anion. Mixtures of these diesters with the corresponding monoesters are described together with preparative methods.

21 Claims, No Drawings

FABRIC TREATMENT MATERIALS

This invention relates to cationic compounds suitable for treatment of fabrics to impart a softening effect to them.

A fabric property appreciated by the user is the softness of the faric when in contact with the skin. A technique used in fabric washing to to treat the washed fabrics in the rinsing cycle with a compound substantive to the fabric and capable of imparting a soft feel to the fabric. Products containing these substantive compounds are on sale in many countries and a typical cationic compound used in commercial products is ditallow dimethyl ammonium chloride.

The invention provides quaternary ammonium salts providing fabric softening properties and containing ester linkages. These chemical compounds have the general formula

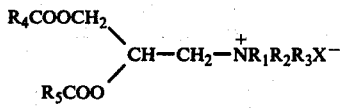

where $R_1R_2$ and $R_3$ are each alkyl or hydroxyalkyl group containing from 1 to 4 carbon atoms, or a benzyl group, $R_4$ and $R_5$ are each alkyl chains containing from 11 to 23 carbon atoms, and $X^-$ is a water soluble anion.

Preferably $R_1$,$R_2$ and $R_3$ ae each $C_1$ or $C_2$ and preferably $R_4$ and $R_5$ are each in the range $C_{15}$ to $C_{23}$. Degrees of branching and non-saturation may be present in the alkyl chains. The anion $X^-$ in the molecule is preferably the anion of a strong acid and can be, for example chloride, bromide, iodide, sulphate and methyl sulphate; the anion may carry a double charge in which case $X^-$ represents half a group.

U.S. Pat. No. 3,342,840 (Shell) discloses a method of producing the corresponding monoester quaternary ammonium salt of formula $R_4COOCH_2CH(OH)CH_2NR_1{}^+R_2R_3X^-$ wherein $R_4$ contains from 8 to 29 carbon atoms. We have found the methods of preparation described by Shell produces trace quantities of the class of diester quaternary ammonium salts to which this invention is directed. The diester quaternary ammonium salts of the present invention provide a greater fabric softening effect than the equivalent monoester derived from the same fatty acid feedstock. Therefore in any mixture of the two classes of compound it is necessary to maximise the amount of diester quaternary ammonium salts present to obtain the greatest fabric softening effect. The methods of the invention given herein provide diester quaternary ammonium salts substantially free of monoester quaternary ammonium salts (that is containing less than about 5% of the monoester) or in admixture with only minor quantities thereof. The invention includes mixtures of the monoester quaternary ammonium salts and diester quaternary ammonium salts comprising at least 50% by weight of the latter, preferably at least 75% by weight and more preferably 90% by weight. General methods for manufacture of the invention are (with $R_1R_2R_3R_4R_5$ and X being as defined previously):

i. A compound of formula $CH_2(OH)CH(OH)CH_2NR_1R_2$ is reacted with a fatty acid of formula $R_4COOH$ or $R_5COOH$. The molar proportion of fatty acid to amine is preferably in the range 1.5:1 to 2:1; more preferably at or near the 2:1 end of the range. If fatty acid is used above 2 molar then free fatty acid remains in the product and is neutralised by alkali used at a later step. Use of less than the stoichiometric quantity of fatty acid leads to formation of the monoester. An amount of this material admixed with the diester can be tolerated but the presence of soap is not desired. The reaction is performed above the temperature at which the fatty acid is molten but below degradation temperature; preferably it is performed in the range about 120° C. to about 190° C. If a specific fatty acid is used, for example stearic acid, then $R_4$ will be identical with $R_5$ in the generic diester formula. The majority of acids used are derived from natural or synthetic acids without separation of components and will contain a mixture of acids. The molecules formed in this case will contain $R_4$ and $R_5$ randomised dependant on the feedstock. The reaction above causes esterification at the two —OH groups and the diesterified product is subject to a quaternisation reaction with a material of formula $R_3X$ in a suitable organic solvent. The desired product is separated and may be purified, for example by recrystallisation. An alternative to quaternisation with $R_3X$ is to form the amine salt by reaction with an acid of formula HX; with subsequent alkoxylation, preferably ethoxylation, to give the quaternary compound. This method provides compounds wherein $R_3$ is hydroxyalkyl. In the Examples, the fatty acids used were derived from hardened tallow and rape seed oil.

ii. A compound of formula

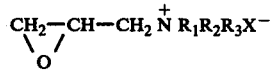

is reacted with fatty acid anhydride of general formula $(R_4CO)_2O$ in approximately molar proportions in the presence of a catalytic amount of an acid to open the epoxy ring. The molar proportions of anhydride to epoxy compound is preferably in the range 1:1 to 1.5:1. A non-hydroxylated solvent is used as the medium so that the anhydride does not convert to the acid.

The quaternary ammonium salts of the invention, i.e. the diesters or mixture thereof with monoesters will preferably be used in a dispersion containing about 2% to about 15% by weight of the material in an aqueous phase. The dispersions will optionally contain other ingredients known for use in liquid fabric softening products, for example electrolytes, perfumes, colouring materials, solvents, e.g. short chain alcohols nonionic detergent actives, materials to give the desired pH value and antioxidants. This aqueous dispersion will be diluted in use to form the rinse liquor for the washed fabrics.

The composition is used to soften fabrics by dispersing the product in water to give 0.002% to 0.035% quaternary ammonium salts in the rinse liquor.

Examples of fabric softening compounds of the invention will now be given together with methods for their preparation to illustrate but not limit the invention.

EXAMPLE 1

The compound wherein $R_4$ and $R_5$ are derived from tallow fatty acids; $R_1$,$R_2$ and $R_3$ are methyl and X is chlorine was prepared. Tallow fatty acids have the chain length distribution of $C_{14}$ 5%, $C_{16}$ 30%, $C_{18}$ (saturated) 20%, and $C_{18}$ (unsaturated) 45%. 3-chloropropan 1,2-diol was reacted with dimethyl amine to form dimethyl-amino-propan 1,2-diol (compound A) by elimination of hydrochloric acid. The hydrochloric acid was neutralised by addition of sodium hydroxide and the sodium chloride formed removed by filtration. Compound A was purified by distillation.

Compound A (34.5g) and tallow fatty acids (175g) were mixed and heated for 7 hours at 120° C. During this time water (11 ml) distilled off. Subsequently heating was continued for a further 15 hours under vacuum at 185° C. The esterified product (175g) was suspended in acetone (200 ml) and treated with methyl chloride in a stirred autoclave maintained at 45° C. and 3 atmospheres gauge pressure. Reaction was continued for 3 hours during which the esterified product was converted into the quaternary ammonium salt. The quaternary compound was precipitated (95g approximately 36% of theoretical yield) and recrystallised from acetone to give substantially pure diester quaternary ammonium salt.

The fabric softening properties of this material (Compound C) was studied and found to be superior to that achieved with ditallow dimethyl ammonium chloride (DDAC). The softening properties of $RCOOCH_2CH_2N^+(CH_3)_3Cl^-$(Compound D) wherein RCOO is derived from hardened rape seed oil fatty acids and $(RCOOCH_2CH_2)_2N^+(CH_3)H.Cl^-$(Compound E), wherein RCOO is derived from hardened tallow fatty acids, were also studied by the following procedure.

Dispersions of each softening compound were prepared with a concentration of 0.005% weight/volume using 240 ppm hardness water calculated as calcium and magnesium carbonates. Three terry towelling cotton pieces with a total weight of 40g were rinsed in 800 mls samples of these dispersions in a pot of a Tergo-To-Meter (Registered Trade Mark) at 25° C. for 5 minutes at 50 revolutions per minute. After rinsing the pieces were spun dried and dried in a hot air cabinet prior to assessment by a panel. Each compound was tested in a separate pot and the three sets of four pieces of towelling were each ranked by each member of the five members of the panel on a scale of 1 (softest) to 4 (harshest). This procedure was performed 4 times. The average rankings are given in Table 1.

Table 1

| | Ranking |
|---|---|
| Compound C | 1.43 |
| DDAC | 1.57 |
| Compound D | 3.15 |
| Compound E | 3.85 |

The experiment was repeated using cotton terry towelling pieces and a nylon (Registered Trade Mark) fabric. Compound C was compared with DDAC and two compounds with the general formula $RCOOCH_2CH(OH)CH_2N^+(CH_3)_3Cl^-$. In compound F, RCOO is derived from a mixture of fatty acids with chain lengths and amounts $C_{16}$ (0.9%), $C_{18}$ (22.3%), $C_{20}$ (12.4%), $C_{22}$ (63.7%) and $C_{24}$ (0.7%) and in Compound G, RCOO is derived from isostearic acid. The treated fabrics were ranked as previously and the results are given in Table II.

Table II

| | Ranking | |
|---|---|---|
| | Cotton | Nylon |
| Compound D | 1.78 | 1.78 |
| DDAC | 2.25 | 2.07 |
| Compound F | 2.42 | 3.05 |
| Compound G | 3.55 | 3.10 |

EXAMPLE 2

The compound in which $R_4$ and $R_5$ are derived from rape seed oil fatty acids was prepared. Hardened rape seed oil fatty acids was prepared. Hardened rape seed oil fatty acids have the chain length distribution of $C_{18}$ 35%, $C_{20}$ 18%, and $C_{22}$ 40%.

Compound A (28g) prepared as described in Example 1 was esterified with hardened fatty acids obtained from rape seed oil (165g) and reacted as described in Example 1.

The esterified product (158g) was suspended in acetone (300 ml) and converted into the quaternary compound by reaction with methyl chloride in a stirred autoclave at 70° C. The pressure in the autoclave was 3.5 atmospheres gauge and the reaction was continued for 13 hours. The product was washed 3 times with ether and 129g were obtained. To remove impurities 25g samples of the crude product were separated on silica gel (500g) using a chloroform/methanol/water mixture in the ratio 65/25/4. Fractions containing cationic were collected and give 18.6g of the substantially pure diester quaternary ammonium salt after washing with ether.

EXAMPLE 3

A product containing a mixture of the monoester and diester quaternary ammonium salt was prepared by reacting glycidyl trimethyl ammonium chloride (compound B) with tallow fatty acid anhydride. A catalytic quantity of acid must be present to initiate ring opening, this amount will normally be present in the anhydride. Compound B (76g) was mixed with dimethyl formamide (30ml freshly distilled) and tallow fatty acid anhydride (528g) added. The fatty acid anhydride was prepared by reacting the fatty acids with acetic anhydride. The mixture was stirred for 4 hours at 80° C. The product was recrystallised from ethyl acetate to give 131g of a product the cationic content of which contained about 75% by weight of diester and 25% of the monoester quaternary ammonium salt.

The product of this Example was compared to DDAC, dicoconut fatty acid dimethyl ammonium chloride (DCDAC) and $R.OOC\ CH_2N^+(CH_3)_3Cl^-$(compound J), wherein R is derived from a petroleum derived alcohol having a chain length distribution $C_{18}$ (12%), $C_{20}$ (63%), and $C_{22}$ (25%) and obtainable from Condea under the Trade Mark Alfol 2022, using the process of ranking on cotton fabric described in Example I. The results given in Table III show the best fabric softening effect is achieved with the product of this Example.

Table III

| | Ranking |
|---|---|
| DDAC | 1.73 |
| DCDAC | 3.47 |
| Example 3 product | 1.52 |
| Compound J | 3.28 |

EXAMPLE 4

The softening properties of the pure cationic diester quaternary ammonium salt (Compound C) prepared by the process of Example 1 were studied alone and in admixture with the equivalent monoester salt $RCOOCH_2CH(OH)CH_2N^+(CH_3)_3Cl^-$(Compound H) wherein RCOO is derived from hardened tallow fatty acid (Pristerine 63 obtainable from Price's Chemicals Limited, Bromborough, England). Dispersions of the compounds and mixtures listed in Table IV were prepared by dissolving 1g of the material in ethanol (2 ml) if necessary with heating and adding water of hardness previously described to make 1 liter of dispersion (0.1% w/v). 40 ml samples were then made up to 800 ml and cotton terry towelling pieces subjected to rinsing in these dispersions (0.005 w/v) using the procedure described in Example 1 modified to examine five test materials. Table IV lists average ranking for the softening effect of individual compounds and three mixtures.

Table IV

| Amount of each compound in material made up as dispersion (as a percentage) | | |
|---|---|---|
| Compound C | Compound H | Ranking |
| 100 | nil | 2.25 |
| 75 | 25 | 2.91 |
| 50 | 50 | 3.01 |
| 25 | 75 | 3.43 |
| nil | 100 | 3.40 |

These results show the advantage of having at least 50% by weight of the diester in a mixture with the corresponding monoester.

EXAMPLE 5

The quaternary ammonium salt of Example 1 was made up to a product for commercial use by forming a dispersion in water. This product contained 5% of the quaternary ammonium salt and 50 mls was dispersed in 15 liter of 240 ppm hard water at 20° C. to form a rinse solution. Washed cotton towelling (1 kg dry weight) was thoroughly rinsed, immersed in the diluted dispersion and agitated for two minutes. The fabric was removed from the liquor and dried to give a softened towelling.

EXAMPLE 6

This Example describes the preparation of the compound wherein $R_4$ and $R_5$ are derived from tallow fatty acids; $R_1R_2$ and $R_3$ are methyl and X is chlorine. In this process the intermediates were not separated; therefore a less pure final product was obtained. Epichlorohydrin (4.6g) was hydrolysed by boiling with 50ml sulphuric acid (1% aqueous) for 3 hours. The bulk of the water was then removed in a rotary evaporator. The product, substantially 3-chloropropan 1,2-diol, was added to a solution of dimethylamine (40% aqueous) and sodium hydroxide (0.02 mol) and the total allowed to stand for 24 hours. Sodium hydroxide (0.03 mol) was added dropwise and the water removed by distillation and rotary evaporation.

The residue was dissolved in methanol, the sodium salts were centrifuged off mixed with tallow fatty acids (0.1 mol) and the product evaporated to dryness. The product was then heated at 120° C. for 7 hours and at 185° C. for 15 hours undervacuum.

Quaternisation was performed using methyl chloride in isopropanol with contact for 20 hours at 50° C.

Quantitative thick layer chromatography showed the separated product to contain 62% of the desired diester. This was separated by recrystallisation in acetone to give the substantially pure diester which was shown to have the properties of compound C of Example 1.

EXAMPLE 7

An alternative to quaternisation with a compound $R_3X$ as described in Example 1 (methyl chloride) is to form the amine salt and then alkoxylate the salt.

The esterified product of Example 1 is reacted with hydrochloric acid (dilute) in the stiochiometric amount to form the corresponding amine salt which is recovered by evaporation. The salt is subjected to ethoxylation by reaction with the stoichiometric amount of ethylene oxide in an autoclave. The product is purified by recrystallisation from acetone and is the analogue of compound C having $R_3$ as ethoxy not methyl.

What we claim is:

1. A chemical compound which is substantially free of the corresponding monoester having the formula:

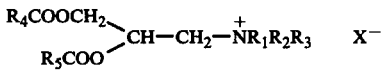

wherein $R_1$, $R_2$ and $R_3$ are each an alkyl or hydroxy alkyl group containing from 1 to 4 carbon atoms, or a benzyl group; $R_4$ and $R_5$ are each an alkyl or alkenyl chain containing from 11 to 23 carbon atoms; and $X^-$is a water soluble anion.

2. A chemical compound according to claim 1 wherein $R_1$, $R_2$ and $R_3$ each contain 1 or 2 carbon atoms.

3. A chemical compound according to claim 1 wherein $R_4$ and $R_5$ each contain from 15 to 23 carbon atoms.

4. A mixture of the chemical compound of claim 1 with the corresponding monoester, the former being present in the mixture in an amount of at least 50% by weight.

5. A mixture according to claim 4 wherein the compound is present in an amount of at least 75% by weight.

6. A mixture according to claim 4 wherein the compound is present in an amount of at least 90% by weight.

7. A method of preparing the compound of claim 1 wherein i. an amine compound of the formula $CH_2(OH)CH(OH)CH_2NR_1R_2$ is reacted with a fatty acid of the formula $R_4COOH$ and/or $R_5COOH$ in molten form to esterify the hydroxy groups; and ii. the reaction product is quaternized.

8. A method according to claim 7 wherein step (i) is performed at a temperature in the range of from about 120° C. to about 190° C.

9. A method according to claim 7 wherein the molar proportion of fatty acid to amine is in the range of 1.5:1 to 2:1.

10. A method according to claim 7 wherein the quaternization is achieved by reacting the product of step (i) with a compound of the formula $R_3X$ in an organic solvent.

11. A method according to claim 7 wherein the quaternization is achieved by reacting the product of step (i) with an acid of the formula HX to form the amine salt, and then alkoxylating the salt to form a product compound wherein $R_3$ is hydroxyalkyl.

12. A method of preparing a compound according to claim 1 wherein a compound of the formula

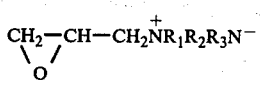

is reacted with fatty acid anhydride of the formula $(R_4CO)_2O$ in a non-hydroxylated solvent in the presence of a catalytic amount of an acid capable of opening the epoxy ring.

13. A method according to claim 12 wherein the molar proportion of acid anhydride to epoxy compound is in the range of from 1:1 to 1.5:1.

14. An aqueous dispersion containing the compound of claim 1.

15. An aqueous dispersion according to claim 14 containing from about 2% to about 15% by weight of the compound.

16. An aqueous dispersion containing the mixture of claim 4.

17. An aqueous dispersion according to claim 16 containing from about 2% to about 15% by weight of the mixture.

18. An aqueous dispersion containing the mixture of claim 5.

19. An aqueous dispersion according to claim 8 containing from about 2% to about 15% by weight of the mixture.

20. An aqueous dispersion containing the mixture of claim 6.

21. An aqueous dispersion according to claim 20 containing from about 2% to about 15% by weight of the mixture.

* * * * *